US005595547A

United States Patent [19]

Lekavich

[11] Patent Number: 5,595,547

[45] Date of Patent: Jan. 21, 1997

[54] MATCHED GOLF CLUB SET HAVING V-SHAPED GROOVES THAT CHANGE FROM CLUB TO CLUB

[76] Inventor: Carl W. Lekavich, 21529 Menlo Ave., Torrance, Calif. 90502

[21] Appl. No.: 401,905

[22] Filed: Mar. 10, 1995

[51] Int. Cl.[6] ..... A63B 53/00

[52] U.S. Cl. ..... 473/287; 473/330; 473/314

[58] Field of Search ..... 273/77 A, 169, 273/167 B, 167 F, 167 J; 473/287, 290, 330, 331, 314, 349, 316

[56] References Cited

U.S. PATENT DOCUMENTS

| | | | |
|---|---|---|---|
| 3,751,035 | 8/1973 | Lockwood . | |
| 3,984,103 | 10/1976 | Nix . | |
| 4,147,349 | 4/1979 | Jeghers . | |
| 4,679,791 | 7/1987 | Hull . | |
| 4,784,390 | 11/1988 | Horgen | 273/77 A |
| 4,941,666 | 7/1990 | Suganuma . | |
| 4,971,321 | 11/1990 | Davis . | |
| 5,029,864 | 7/1991 | Keener . | |
| 5,121,918 | 6/1992 | Teramoto et al. | 273/77 A |
| 5,228,688 | 7/1993 | Davis . | |
| 5,333,859 | 8/1994 | Teramoto et al. | 273/77 A |
| 5,429,353 | 7/1995 | Hoeflich | 273/77 A |

FOREIGN PATENT DOCUMENTS

051748A1 12/1992 European Pat. Off. .

*Primary Examiner*—William M. Pierce
*Attorney, Agent, or Firm*—Richard C. Litman

[57] ABSTRACT

A set of golf club irons having common swing weights segregated into distance irons, fairway irons and accuracy irons, each grouping having common shaft lengths and lie angles. Each club head is vertically, horizontally and laterally balanced about its sweet spot. The areas of the faces of each club are substantially identical.

Each club face has multiple, generally parallel, horizontal, V-shaped scoring. The distance and fairway irons have scoring which promotes top spin in the ball. The accuracy irons have scoring which promotes back spin.

9 Claims, 5 Drawing Sheets

MATCHED GOLF CLUB SET HAVING V-SHAPED GROOVES THAT CHANGE FROM CLUB TO CLUB

BACKGROUND OF THE INVENTION

1. Field of the Invention

This invention relates to golf clubs. Specifically, the present invention relates to a set of irons dimensioned and configured to permit the user to maintain the same swing for each.

2. Description of the Prior Art

For clarity, the three-dimensional Cartesian coordinates referred to herein are oriented such that the reference plane is generally horizontal and defines the X-Y plane. In most cases, the reference plane contains the players two feet and the ball. The players feet lie along the X-axis. The Y-axis intersects the X-axis between the players feet and extends forward through the ball. The Z-axis extends orthogonally up from the intersection of the X-and Y-axes.

Golf is an exceedingly difficult sport. Golfers must master a plurality of static and dynamic variables in order to play the game with any modicum of success. Golf club characteristics play a significant role in the type and severity of variables encountered.

Golf clubs have four basic attributes which often vary from club to club: (1) weight; (2) length from the top of the handle to the heel of the club; (3) loft angle of the face that contacts the ball relative to the reference plane; and (4) lie angle of the shaft relative to the reference plane. Diversity in club attributes, unfortunately, means that a golfer's mastery of the variables to properly play one club will not necessarily lend to well-tempered play of another.

Reduction of club attribute variability reduces the overall number of variables with which golfers must contend. Ideally, constructing a set of clubs that permits a golfer to use the same stroke for each club grants golfers the luxury of concentrating more effort toward learning and perfecting that one stroke. Matched golf sets which purport to be designed for a universal club stroke enhance the sport and provide greater enjoyment to players.

Several types of matched golf club sets are described in the literature. For example, U.S. Pat. No. 3,751,035, issued Aug. 7, 1973, to John W. Lockwood, describes a set of golf club irons. The clubs have elliptical faces of common area. The sweet spot of each face, the most effective part of the club for striking a ball, is centered within the face of the club.

U.S. Pat. No. 3,984,103, issued Oct. 5, 1976, to Jack W. Nix, describes a set of golf clubs including woods and irons. The clubs falling into the "wood" class have the same length, lie angle, swing weight and total weight. Similarly, the clubs falling into the "iron" class have the same length, lie angle, swing weight and total weight. The invention also provides for the clubs falling into both the "wood" and "iron" classes all having the same length, lie angle, swing weight and total weight.

U.S. Pat. No. 4,147,349, issued Apr. 3, 1979, to Phillippe M. Jeghers, describes a set of golf club irons. Each club head defines the same frontal area. The frontal area is shown as being the projection of the face in the Y-Z plane. Club face surface area increases as loft angle decreases to maintain the same projection as the other clubs. Each club, when in contact with the ball, has its center of gravity located at the same distance from the reference plane as the others. Positioning of the center of gravity relative to the club face differs according to loft angle.

U.S. Pat. No. 4,679,791, issued Jul. 14, 1987, to Donald R. Hull, describes a set of golf club woods and irons. The clubs falling into the "wood" class have the same weight, length, and lie angle. Similarly, the clubs falling into the "iron" class have the same weight, length, lie angle. The clubs falling into both the "wood" and "iron" classes have heads in which the center of gravity is facially centered. The invention also describes each club having a grip with a flattened elliptical shape, the elongated portion of the grip being disposed along the Y-axis.

U.S. Pat. No. 4,941,666, issued Jul. 17, 1990, to Noriyuki Suganuma, describes a set of golf club woods and irons. The clubs are configured such that head mass increases as shaft length decreases. Club length is described as being inversely proportional to the second moment of inertia about an axis defined by the grip and club mass center. The length also may be related to the natural frequency of the club. The weight of the club is described as varying according to the particular function for which the club is used, such as putting or chipping.

U.S. Pat. No. 4,971,321, issued Nov. 20, 1990, to C. Michael Davis, describes a set of golf club woods and irons. The clubs falling into the "wood" class have the same length, shape, and mass differing only in loft angle. The clubs falling into the "iron" class are further segregated into three subclasses. The clubs falling into each subclass have the same length, shape, and mass differing only in loft angle. The clubs falling into both the "wood" and "iron" classes each maintain the same distance between a lower grip line, a line falling below the bottom hand, and the hosel or heel of the club. The clubs having longer overall shaft lengths have more grip extended above the top hand for maintaining greater counterbalancing than the shorter clubs.

U.S. Pat. No. 5,029,864, issued Jul. 9, 1991, to Michael B. Keener, describes a set of golf club irons. The clubs have common weight and length. Each club has a face including multiple horizontal, V-shaped scoring. The V-shaped groove is purposed at imparting backspin on a golf ball. The V-shape has a normal and a contact face relative to the face of the club. The normal face is the upper shelf of the V-shape. The angle of the normal face relative to the face of the club depends on the loft angle of the club and is configured to be substantially not in contact with the ball. The normal face extends into the face of the club no more than 5 mm. The contact face extends from the deepest point of the normal face downward and outward. The angle between the contact face and the club face ranges between 30° and 70°.

U.S. Pat. No. 5,228,688, issued Jul. 20, 1993, to C. Michael Davis, a continuation-in-part to U.S. Patent No. 4,971,321, describes a set of golf club woods and irons. The clubs have common upper and lower grip lines. However, each club has a different length, weight and lie angle with respect to the others.

European Patent No. 0517487A1, published Dec. 9, 1992, issued to Acushnet Co., describes a set of golf club irons. The back cavity of each club is configured such that the center of mass and club head coincide.

None of the above references, taken alone or in combination, are seen as teaching or suggesting the presently claimed matched golf club set.

SUMMARY OF THE INVENTION

The present invention relates to a set of golf club irons. Each club has a head, shaft and grip. The clubs are segregated into three groups. The distance irons, numbered 1 through 4, have common shaft lengths and lie angles. The fairway irons, numbered 5 through 7, have common shaft lengths which are shorter than the shaft lengths of the distance irons. The fairway irons have common lie angles which are greater than the lie angles of the distance irons. The accuracy irons, recognized as 8, 9, pitching wedge, intermediate pitching wedge, loft and sand wedge, have common shaft lengths which are shorter than the shaft lengths of the fairway irons. The accuracy irons have common lie angles which are greater than the lie angles of the fairway irons.

Each club head has a face with a sweet spot. Each club head is vertically, horizontally and laterally balanced about this sweet spot. Gravity acts against this combination of face alignment attributes and urges the club head to naturally assume a proper striking attitude relative to the ball while stroking it. The areas of the faces of each club are substantially identical.

All of the clubs are intended to have the same swing weight. As shaft length decreases, head weight increases to make up the difference. The combination of length-weight adjustments and the balancing properties of the head permit a golfer to use the same stroke for any club in the set. Being able to use the same stroke will permit golfers to dramatically and rapidly improve their playing abilities.

Each club face has multiple, generally parallel, horizontal, V-shaped scoring. The configuration of the V-shape differs according to the loft angle of the club. The distance irons and fairway irons have scoring which promotes top spin to the ball. The accuracy irons have scoring which promotes back spin.

In consideration of the above, an object of the invention is to provide a set of golf club irons having common weights, but varied shaft lengths and lie angles for permitting use of a common or uniform swing with each club.

Another object of the invention is to provide a set of golf club irons which are vertically, horizontally and laterally balanced; thus, golfers will more accurately position themselves and stroke the ball with increased potential for striking the ball with the sweet spot of the club head.

A further object of the invention is to provide a set of golf club irons having multiple, generally parallel, horizontal, V-shaped scoring for imparting top spin on the ball with the distance and fairway irons and for imparting back spin on the ball with the accuracy irons.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features of the invention consistently throughout the attached drawings.

DETAILED DESCRIPTION OF THE PREFERRED EMBODIMENT

Figure 1A:
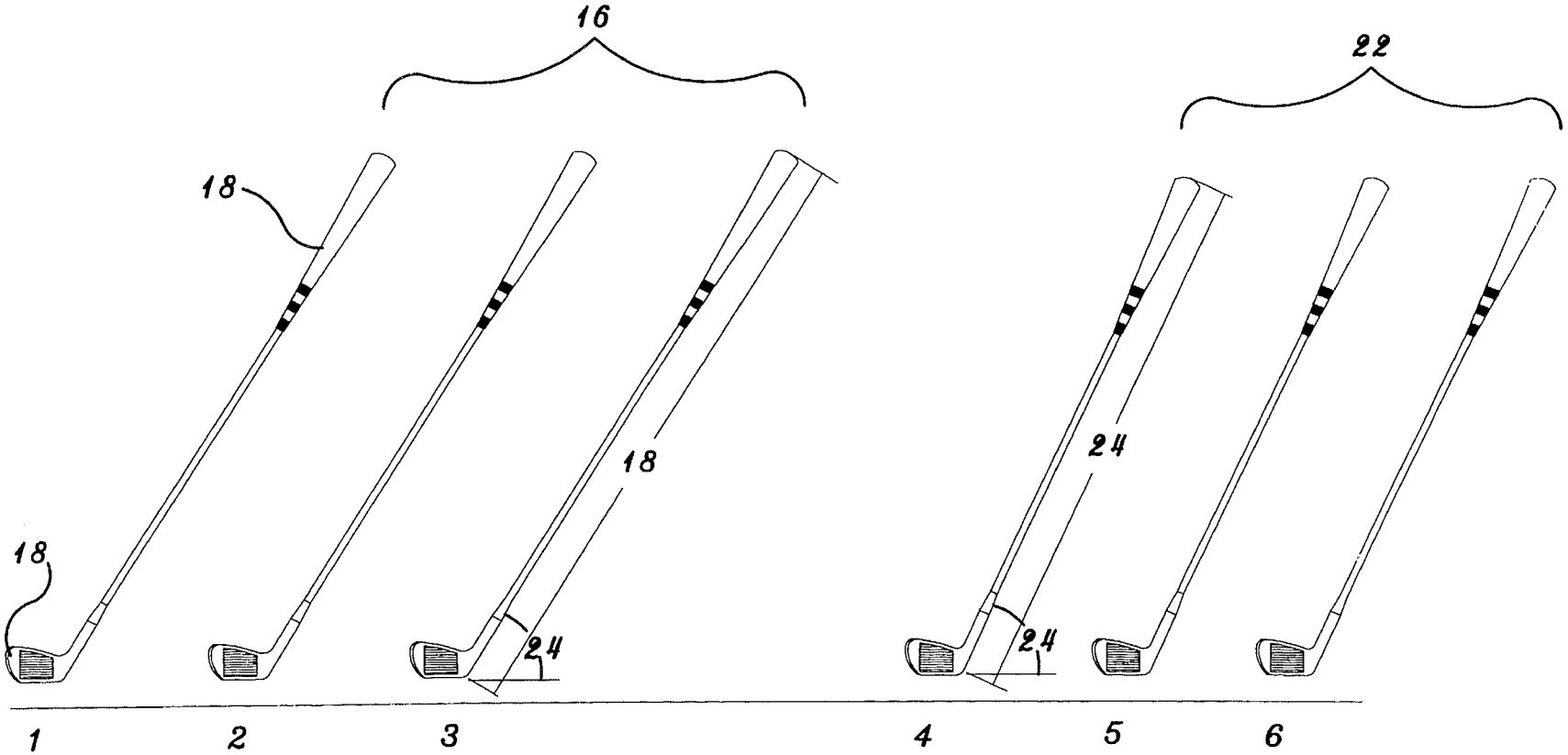
FIGS. 1A and 1B show a series of side elevational views of the clubs, according to the invention.
Figure 1B:
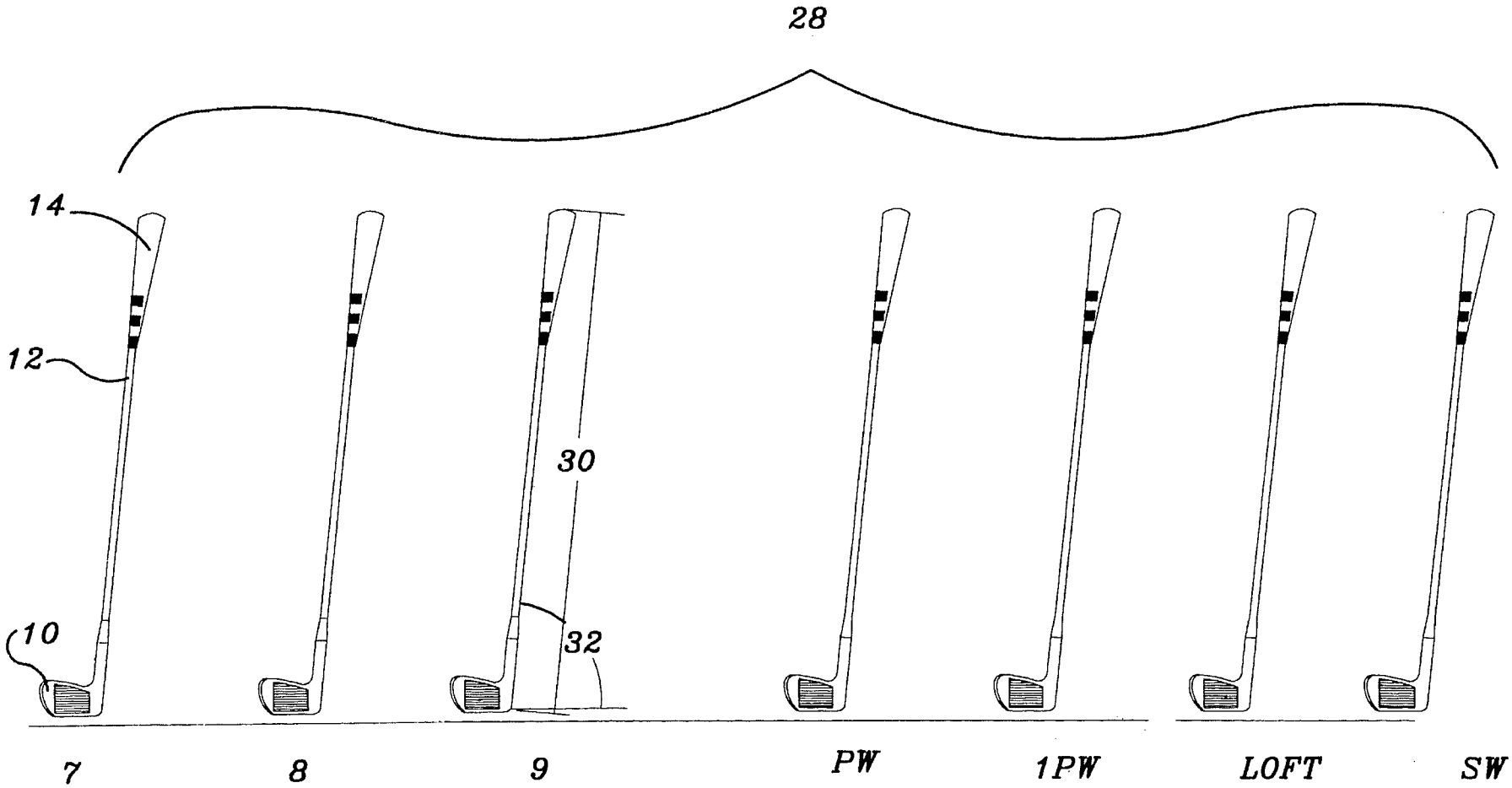

Referring to FIGS. 1A and 1B, all of the golf club irons are shown. Each club has a head 10, shaft 12 and grip 14. The clubs are segregated into three groups. The distance irons 16, numbered 1 through 4, have common shaft lengths 18 and lie angles 20. The fairway irons 22, numbered 5 through 7, have common shaft lengths 24 which are shorter than the shaft lengths 18 of the distance irons 16. The fairway irons 22 have common lie angles 26 which are greater than the lie angles 20 of the distance irons 16. The accuracy irons 28, recognized as 8, 9, pitching wedge (PW), intermediate pitching wedge (IPW), lob (LOB) and sand wedge (SW), have common shaft lengths 30 which are shorter than the shaft lengths 24 of the fairway irons 22. The accuracy irons 28 have common lie angles 32 which are greater than the lie angles 26 of the fairway irons 22. Table I, below, shows how shaft length and lie angle are related.

TABLE I

| Club Group | Shaft Length | Lie Angle |
|---|---|---|
| Distance Irons | 39" | 58° |
| Fairway Irons | 37.5" | 61° |
| Accuracy Irons | 36" | 64° |

Figure 3:
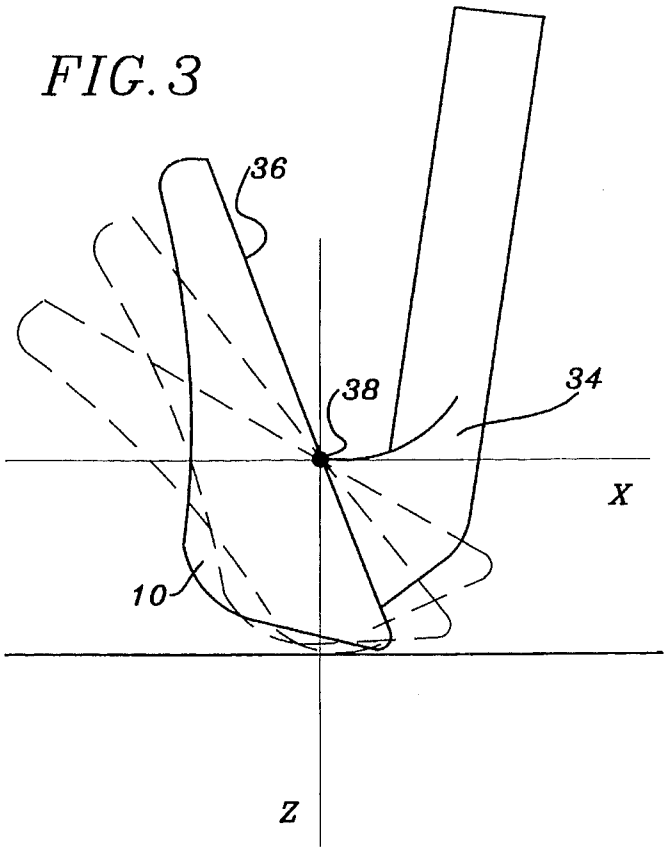
FIG. 3 is a diagrammatic front elevational view of golf club heads, and showing different loft angles.
Figure 2:
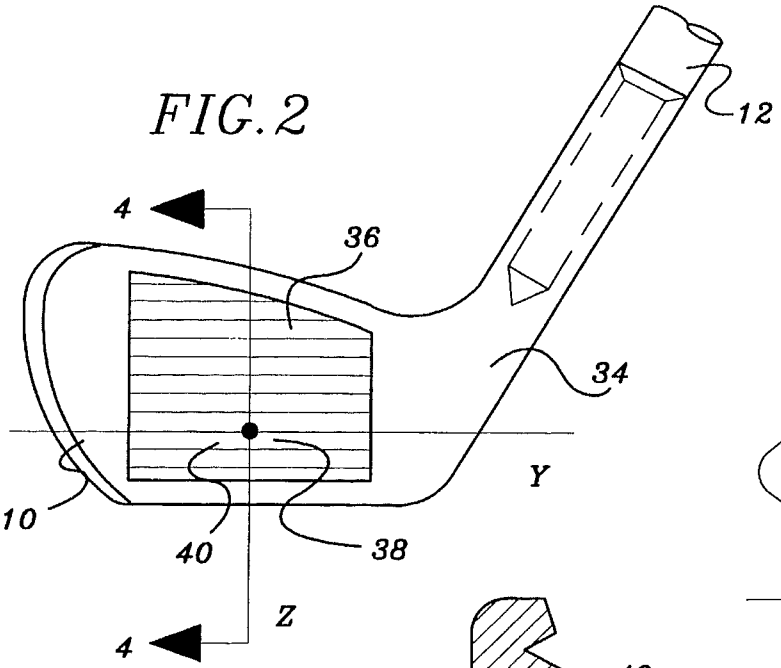
FIG. 2 is a side elevational view of a golf club head.

Referring to FIGS. 2 and 3, a club head 10 is shown. Each head 10 includes a hosel 34, face 36 and sweet spot 38. The areas of the faces 36 of each club are substantially identical. Differences in face areas are necessary to attain the weight and balance properties of each club as discussed below. The hosel 34 is rigidly fixed to the shaft 12 of each club by threaded interengagement, adhesive or other equivalent means, all of which are well known in the art.

Each club head 10 is vertically, horizontally and laterally balanced about the sweet spot 38. Vertical balancing promotes alignment of the face 36 in the Z-direction. Horizontal balancing promotes alignment of the face 36 in the Y-direction. Lateral balancing promotes alignment of the face 36 in the X-direction. Gravity acts against the combination of face alignment attributes and urges the club head 10 to naturally assume a proper striking attitude relative to a ball while stroking it. Proper striking attitude promotes making contact with the ball with the sweet spot 38 of the head 10. Additionally, proper loft angle is maintained. Finally, the face 36 is not rotated about the X-axis.

All of the clubs are intended to have the same swing weight. Club head 10 and shaft 12 weights are adjusted to accommodate differences in shaft length. The combination of length-weight adjustments and the balancing properties of the head permit a golfer to use the same stroke for any club in the set. Being able to use the same stroke will permit golfers to dramatically and rapidly improve their playing abilities.

Figure 4:
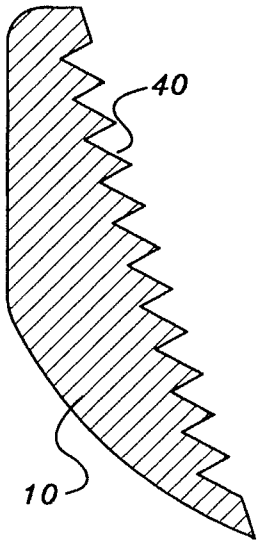
FIG. 4 is an enlarged scale, cross-sectional view, drawn along lines 4—4 of FIG. 2.

Referring to FIGS. 2 and 4, each club face 36 has multiple, generally parallel, horizontal, V-shaped scoring 40. The configuration of the V-shape differs according to the loft angle of the club. The distance irons 16 and fairway irons 22 have scoring 40 for imparting top spin on the ball. Top spin may assist the golfer in deriving more distance from a played ball after it lands, preferably in the appropriate fairway. The accuracy irons 28 have scoring which promotes back spin. Back spin may assist the golfer in arresting forward movement of the played ball after it has landed.

Figure 5A:
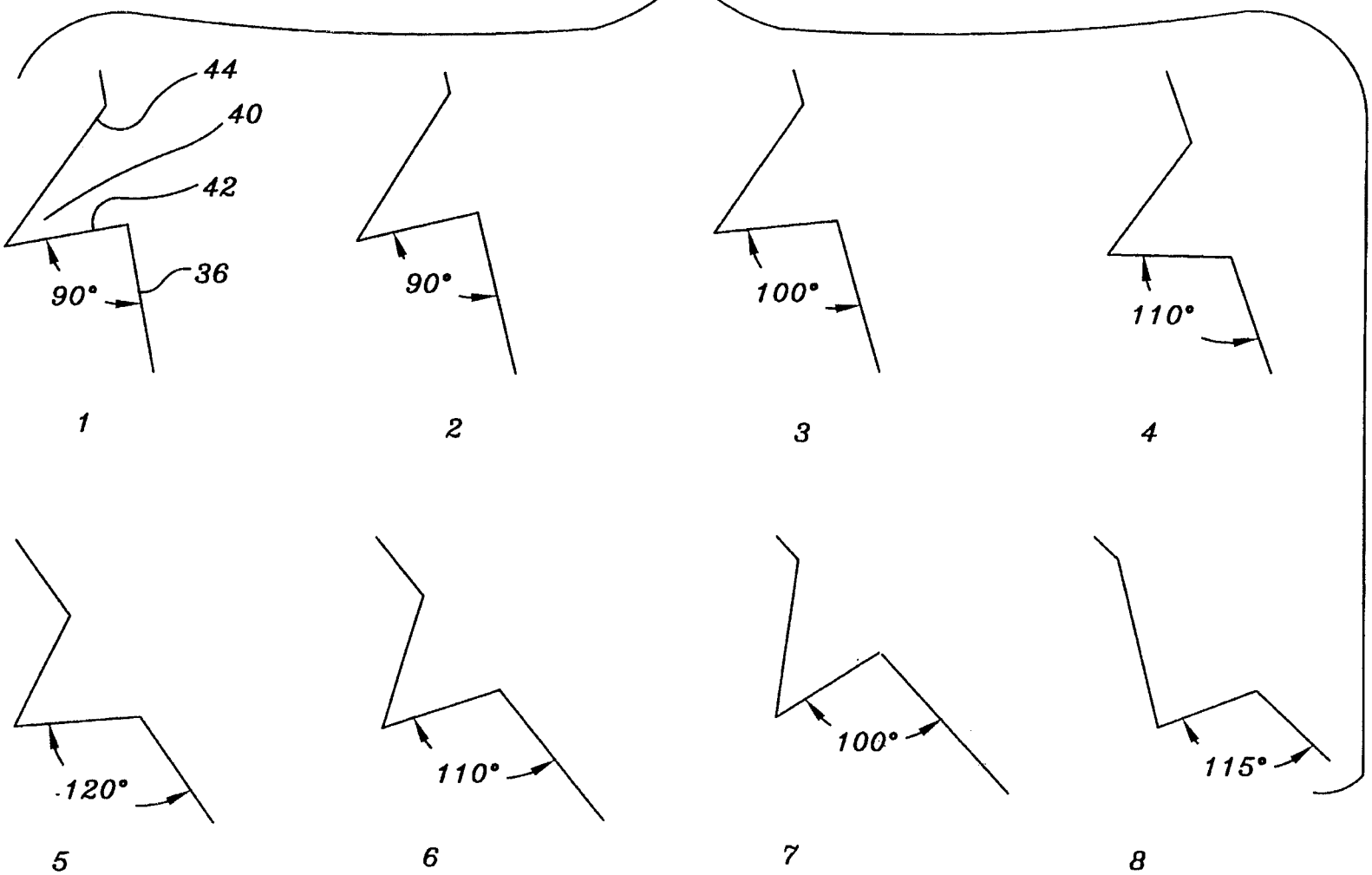
FIGS. 5A and 5B show a series of enlarged scale, diagrammatic, cross-sectional views of the horizontal scoring in the golf club as seen in FIG. 4.
Figure 5B:
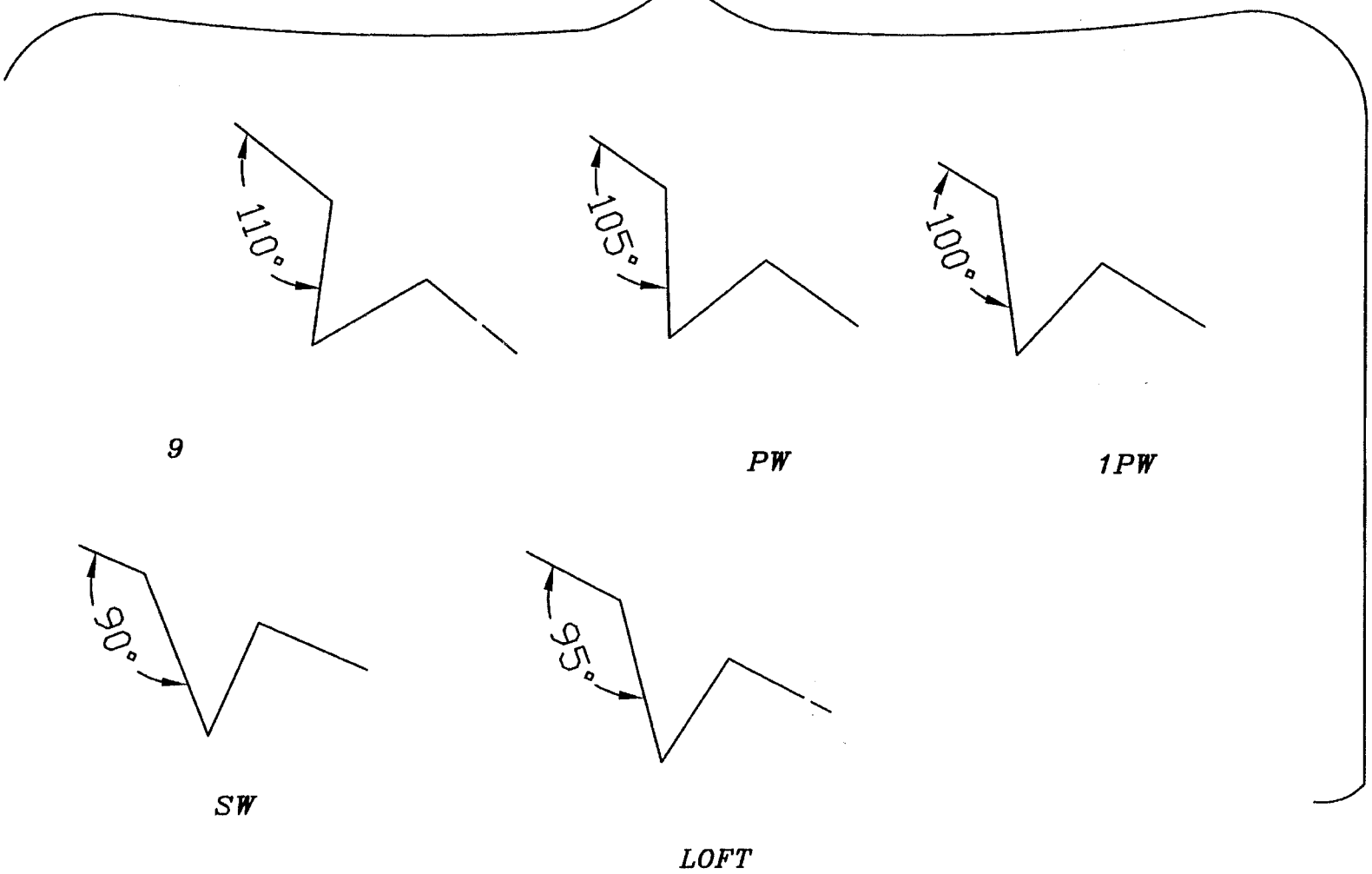

Referring to FIGS. 5A and 5B, configuration of the V-shaped scoring 40 is shown. For the distance irons 16 and fairway irons 22, the V-shape is configured such that the bottom shelf 42 is roughly normal to the face 36 of the club head 10. For the accuracy irons 28, the V-shape is configured such that the upper shelf 44 is roughly normal to the face 36 of the club head 10. Table II, below, shows how loft angle and-normal face angle are related.

TABLE II

| Club | Loft Angle | Normal Face Angle |
|---|---|---|
| 1 | 18° | 90° |
| 2 | 22° | 90° |
| 3 | 26° | 100° |
| 4 | 30° | 110° |
| 5 | 34° | 120° |
| 6 | 38° | 110° |
| 7 | 42° | 100° |
| 8 | 46° | 115° |
| 9 | 50° | 110° |
| Pitching Wedge | 54° | 105° |
| Intermediate Pitching Wedge | 58° | 100° |
| Lob | 62° | 95° |
| Sand Wedge | 66° | 90° |

The present invention is not intended to be limited to the embodiment described above, but to encompass any and all embodiments within the scope of the following claims.

I claim:

1. A set of golf club irons comprising:

a first, a second and a third subset of clubs, each subset containing at least one club, each club comprising:

a grip for grasping and controlling said club, said grip having a central axis;

a shaft having a first and a second end, a shaft length and a central axis coincident with said central axis of said grip, said first end of said shaft being fixed relative to said grip; and a head having:

a face having a surface area for contacting a ball, said face further having a sweet spot, a loft angle and a plurality of horizontal, substantially parallel V-shaped grooves, each groove having an upper and a lower shelf, said lower shelf extending into its face forming an included angle of 90 to 120 degrees with respect to the face of each club within said first and said second subset of clubs, said upper shelf extending into its face forming an included angle of 90 to 115 degrees with respect to the face of each club within said third subset of clubs; and a hosel fixing said head relative to said second end of said shaft, said hosel being dimensioned and configured to define an angle between said head and said shaft, said angle being supplementary to a lie angle;

wherein all of the clubs in said first subset of clubs have a first lie angle and a first shaft length, all of the clubs in said second subset of clubs have a second lie angle and a second shaft length, and all the clubs in said third subset of clubs have a third lie angle and a third shaft length; said third lie angle being greater than said second lie angle which is in turn greater than said first lie angle, and said third shaft length being shorter than said second shaft length which is in turn shorter than said first shaft length; and all of the clubs in each said subset of clubs having a common swing weight.

2. The set of golf club irons as recited in claim 1, wherein all of the clubs in each said subset of clubs have faces with substantially the same surface area.

3. A set of golf club irons comprising:

a first, a second and a third subset of clubs, each subset containing at least one club, each club comprising:

a grip for grasping and controlling said club, said grip having a central axis;

a shaft having a first and a second end, a shaft length and a central axis coincident with said central axis of said grip, said first end of said shaft being fixed relative to said grip; and a head having:

a face having a surface area for contacting a ball, said face further having a sweet spot, a loft angle, and a plurality of horizontal, substantially parallel, V-shaped grooves, each groove having an upper and a lower shelf; said lower shelf extending into its face forming an included angle of 90 to 120 degrees with respect to the face of each club within said first and said second subset of clubs; and said upper shelf extending into its face forming an included angle of 90 to 115 degrees with respect to the face of each club within said third subset of clubs; and a hosel fixing said head relative to said second end of said shaft, said hosel being dimensioned and configured to define an angle between said head and said shaft, said angle being supplementary to a lie angle;

each said head being balanced about an X-, a Y- and a Z-axis in standard Cartesian coordinates, each said axis intersecting at a sweet spot on said face of said head.

4. The set of golf club irons as recited in claim 3 wherein all of the clubs in said first subset of clubs have a first lie angle and a first shaft length, all of the clubs in said second subset of clubs have a second lie angle and a second shaft length, and all the clubs in said third subset of clubs have a third lie angle and a third shaft length; said third lie angle being greater than said second lie angle which is in turn greater than said first lie angle, and said third shaft length being shorter than said second shaft length which is in turn shorter than said first shaft length.

5. The set of golf club irons as recited in claim 3, wherein all of the clubs of each said subset of clubs have a common swing weight.

6. The set of golf club irons as recited in claim 3, wherein all of the clubs in each said subset of clubs have faces with substantially the same surface area.

7. A set of golf club irons comprising:

a first, a second and a third subset of clubs, each subset containing at least one club, each club comprising:

a grip for grasping and controlling said club, said grip having a central axis;

a shaft having a first and a second end, a shaft length and a central axis coincident with said central axis of said grip, said first end of said shaft being fixed relative to said grip; and a head having:

a face having a surface area for contacting a ball, said face further having a sweet spot, a loft angle, and a plurality of horizontal, substantially parallel, V-shaped grooves, each groove having an upper and a lower shelf; said lower shelf extending into its face forming an included angle of 90 to 120 degrees with respect the face of each club within said first and said second subset of clubs; and said upper shelf extending into its face forming an included angle of 90 to 115 degrees with respect to the face of each club within said third subset of clubs; and a hosel fixing said head relative to said second end of said shaft, said hosel being dimensioned and configured to define an angle between said head and said shaft, said angle being supplementary to a lie angle.

8. The set of golf club irons as recited in claim 7, wherein all of the clubs in each said subset of clubs have a common swing weight.

9. The set of golf club irons as recited in claim 7, wherein all of the clubs in each said subset of clubs have faces with substantially the same surface area.

* * * * *